US007261025B2

(12) United States Patent
Wong

(10) Patent No.: US 7,261,025 B2
(45) Date of Patent: Aug. 28, 2007

(54) CIRCULAR SAW BENCH

(75) Inventor: Kelvin Wong, Hong Kong (HK)

(73) Assignee: Robert Bosch GmbH, Stuttgart (DE)

( * ) Notice: Subject to any disclaimer, the term of this patent is extended or adjusted under 35 U.S.C. 154(b) by 196 days.

(21) Appl. No.: 10/538,185

(22) PCT Filed: Jun. 25, 2004

(86) PCT No.: PCT/DE2004/001349

§ 371 (c)(1),
(2), (4) Date: Jun. 9, 2005

(87) PCT Pub. No.: WO2005/025823

PCT Pub. Date: Mar. 24, 2005

(65) Prior Publication Data

US 2006/0053993 A1 Mar. 16, 2006

(30) Foreign Application Priority Data

Aug. 22, 2003 (DE) ..... 103 38 651

(51) Int. Cl.
*B26D 1/14* (2006.01)

(52) U.S. Cl. ..... 83/478; 83/477.2

(58) Field of Classification Search ..... 83/477.2, 83/478

See application file for complete search history.

(56) References Cited

U.S. PATENT DOCUMENTS

| | | | | |
|---|---|---|---|---|
| 1,879,280 A | | 9/1932 | James | |
| 2,466,325 A | * | 4/1949 | Ocenasek | 83/102.1 |
| 3,043,353 A | * | 7/1962 | Taylor et al. | 83/440.2 |
| 3,880,032 A | * | 4/1975 | Green | 83/102.1 |
| 4,721,023 A | | 1/1988 | Barlett et al. | |
| 4,962,685 A | | 10/1990 | Hagstrom | |

FOREIGN PATENT DOCUMENTS

FR 2 544 246 10/1984

* cited by examiner

*Primary Examiner*—Kenneth E. Peterson
*Assistant Examiner*—Isaac N. Hamilton
(74) *Attorney, Agent, or Firm*—Michael J. Striker

(57) ABSTRACT

A table saw (10) includes a table top (16) over which a saw blade (20) is positioned. The upper region is covered by a guard (26) which is height-adjustable relative to the saw blade (20) in particular, and the saw blade (20) is angularly-displaceable relative to the table top (16). A gap (32) is located between the guard (26) and the table top (16). The table saw is made safer to handle by the fact that the guard (26) includes a protective panel (36) which is movably supported relative to the guard (26) and closes the gap (32) in a manner such that it cannot be penetrated by the operator's fingers.

9 Claims, 3 Drawing Sheets

CIRCULAR SAW BENCH

CROSS-REFERENCE

The invention described and claimed hereinbelow is also described in PCT/DE 2004/001349, filed Jun. 25, 2004 and DE 103 38 651.3, filed on Aug. 22, 2003. This German Patent Application, whose subject matter is incorporated here by reference, provides the basis for a claim of priority of invention under 35 U.S.C. 119 (a)-(d).

BACKGROUND OF THE INVENTION

The present invention relates generally to a table saw.

Table saws with a table top are known, over which a saw blade is positioned, whereby the upper region of the saw blade is covered by a guard which is height-adjustable relative to the saw blade and/or the table top, and whereby the saw blade is angularly-adjustable relative to the table top to enable diagonal cuts. If, to make diagonal cuts, the saw blade, together with the guard, is angularly-displaced around a swivelling axis located substantially parallel to the saw blade and in the plane of the table top, a gap forms between the guard and the work piece on the side of the guard which forms an obtuse angle with the table top. The more obtuse this angle is, the larger the gap is and, therefore, the greater the danger is that the operator will become injured during sawing, because his finger can accidentally slip through the gap and contact the saw blade.

SUMMARY OF THE INVENTION

The present invention has the advantage that a risk of injury due to the gap between the guard and the work piece or the table top can be ruled out, whereby effective, simple means for this were created.

Due to the fact that the gap is automatically closed when it forms, regardless of its size, safety is automatically ensured and the previous source of danger is automatically eliminated.

Due to the fact that the protective panel rests with its narrow side on the table top, tries to remain there due to its sufficiently heavy natural weight, and simultaneously bears with its flat side against a side wall of the guard such that it is movable in parallel therewith and can thereby follow any swivelling motions made by the guard, the gap is kept closed regardless of the angular position of the saw blade and, therefore, the guard.

Due to the fact that the protective panel is supported on the side wall of the guard which forms an obtuse angle with the table top when the saw blade is swivelled, the safety-relevant side of the guard is automatically reliably protected.

Due to the fact that the protective panel includes two elongated holes extending perpendicularly to the table top and functioning as guide channels for the parallel displacement of the protective panel relative to the side wall, each of the elongated holes being penetrated by a screw which is screwed into the side wall, the heads—or the like—of which overlap the protective panel, the protective panel is supported using simple means such that it is movable relative to the side wall and is prevented from accidentally coming loose from the guard; this also ensures a secure resting position on the work piece and/or the table top. This is due to the fact that, when the saw blade and/or guard are angularly displaced, the protective panel changes its angular position but not its height relative to the work piece or the table top and reliably keeps the gap closed. In the case of an angular displacement with an increasing obtuse angle, the side wall on which the protective panel is mounted moves upward relative to the protective panel.

Due to the fact that, in the front region of the guard, an offset tab of the protective panel which is transverse to the protective panel and, therefore, transverse to the saw blade, extends in parallel with the elongated holes through a side wall of the guard to shortly before the diametrically opposed side wall, the region of the guard in front of the saw blade is also closed—except for the lateral gap between the side wall and the work piece—to prevent penetration by the hand.

Due to the fact that a side wall of the guard includes a slot which is open downward to allow penetration by the offset tab of the protective panel, the protective panel with its offset tab can extend downward out of this slot at any time or, vice versa, the side wall with the slot can move upward relative to the protective panel as the result of swivelling motion and distance itself therefrom.

Due to the fact that the side wall of the guard with the protective panel includes guide ribs on which the protective panel bears and is capable of gliding, friction between the protective panel and the side wall is minimized, and it is ensured that the two parts can move relative to each other in an unencumbered manner.

Due to the fact that the guard is composed of transparent material, the saw blade and the site of engagement of the saw teeth in the work piece is particularly easy to control.

Due to the fact that the guard is height-adjustable relative to the table top such that a work piece having any (within limits) dimensions fits between the table top and the guard, whereby the guard rests on the work piece, the guard is adaptable to work pieces to be sawed which have different thicknesses.

BRIEF DESCRIPTION OF THE DRAWINGS

The present invention is explained in greater detail below with reference to an exemplary embodiment and an associated drawing.

DETAILED DESCRIPTION OF THE EXEMPLARY EMBODIMENT

Figure 1:
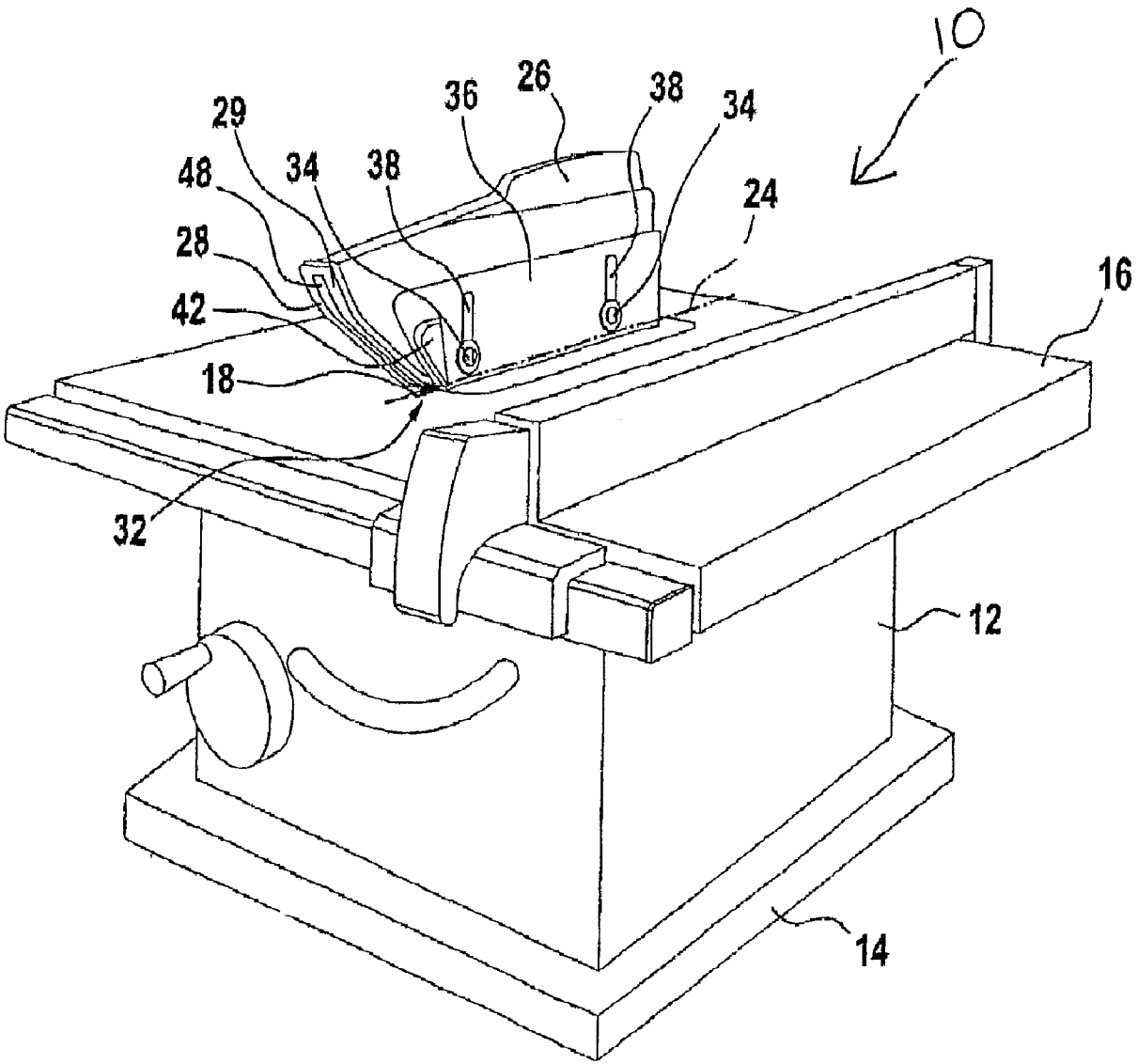
FIG. 1 shows a spacial view of a table saw with guard and protective panel.

A table saw 10 shown in FIG. 1 forms, with its lower frame 12, a base region 14 and stands therewith on a workbench, which is not shown. Seated on top of lower frame 12 is a table top 16 penetrated by a slot 18 extending at a right angle to at least one of the table edges, through which a saw blade 20 (FIG. 3) extends upward, which is covered by a guard 26.

Saw blade 20 is seated on a saw assembly (not described in greater detail) which is supported below table top 16 in a pivotably displaceable manner, whereby saw blade 20 with guard 26 is swivellable toward the left as shown in the figure around a swivelling axis 24 indicated with the dash-dotted line, which is located approximately in the plane of table top 16. Depending on the design of the table saw, the swivelling axis can also be located clearly below the table top.

When swivelled to the left, a gap 32 forms between lower edge 40 of right side wall 29 of guard 26 and table top 16 or a work piece (not shown) capable of being positioned between guard 26 and table top 16. The gap becomes larger as guard 26 is swivelled further to the left, whereby an increasingly obtuse angle forms between right side wall 29 of guard 26 and the surface of the work piece and/or table top 16. Gap 32 forms because guard 36 bears against lower edge 27 of left (as shown in the figure) side wall 28 and is more or less swivelled around it, so that lower edge 27 of right side wall 29 lifts off of the work piece and/or table top 16.

To safely close this gap 32, two guide bolts 34 are fastened in right side wall 29 of guard 26, the bolts retaining a protective panel 36 such that it is displaceable parallel to the surface. The distance of bolt heads 35 from side wall 28 is designed such that protective panel 36 is held with a certain amount of play. Guide bolts 34 extend through two parallel elongated holes 38 in protective panel 36 extending perpendicularly to table top 16, which are so long and therefore allow such a sufficient amount of displacement travel between protective panel 36 and side wall 29 that protective panel 36 still safely closes a maximum gap 32, even when in an extreme angular position. Due to the fact that protective panel 36 tries to keep its lower edge resting on table top 16 due to its natural weight, when guard 26 swivels, it will always move upward relative to protective panel 36 as the angle increases, or downward as the angle decreases.

In its front, left (as shown in the drawing) region, protective panel 36 has a window-like opening 44 which is formed by a substantially C-shaped punched contour, the surface of which is bent at a right angle along a connecting line between the end points of the C-shaped contour, passes through a slot 30 in right side wall 29 of guard 26 (FIGS. 2, 3) and forms a tab 42 extending across to the diametrically opposed side wall 28. This tab 42 prevents frontal penetration by the operator's hand through front opening 48 of guard 26 and therefore reduces the risk that the saw blade will come in contact with the fingers.

Saw blade 20 and guard 26 are located in a right-angled position relative to table top 16, so that a "zero" gap 32 exists and, although protective panel 36, with its front tab 42 bent at a right angle, does not have a lateral gap 32 to close, it still closes front opening 48 of guard 26 with its tab 42 to prevent the operator's hand from accidentally touching the saw blade, therefore also performing a safety function in this position of guard 26.

Figure 2:
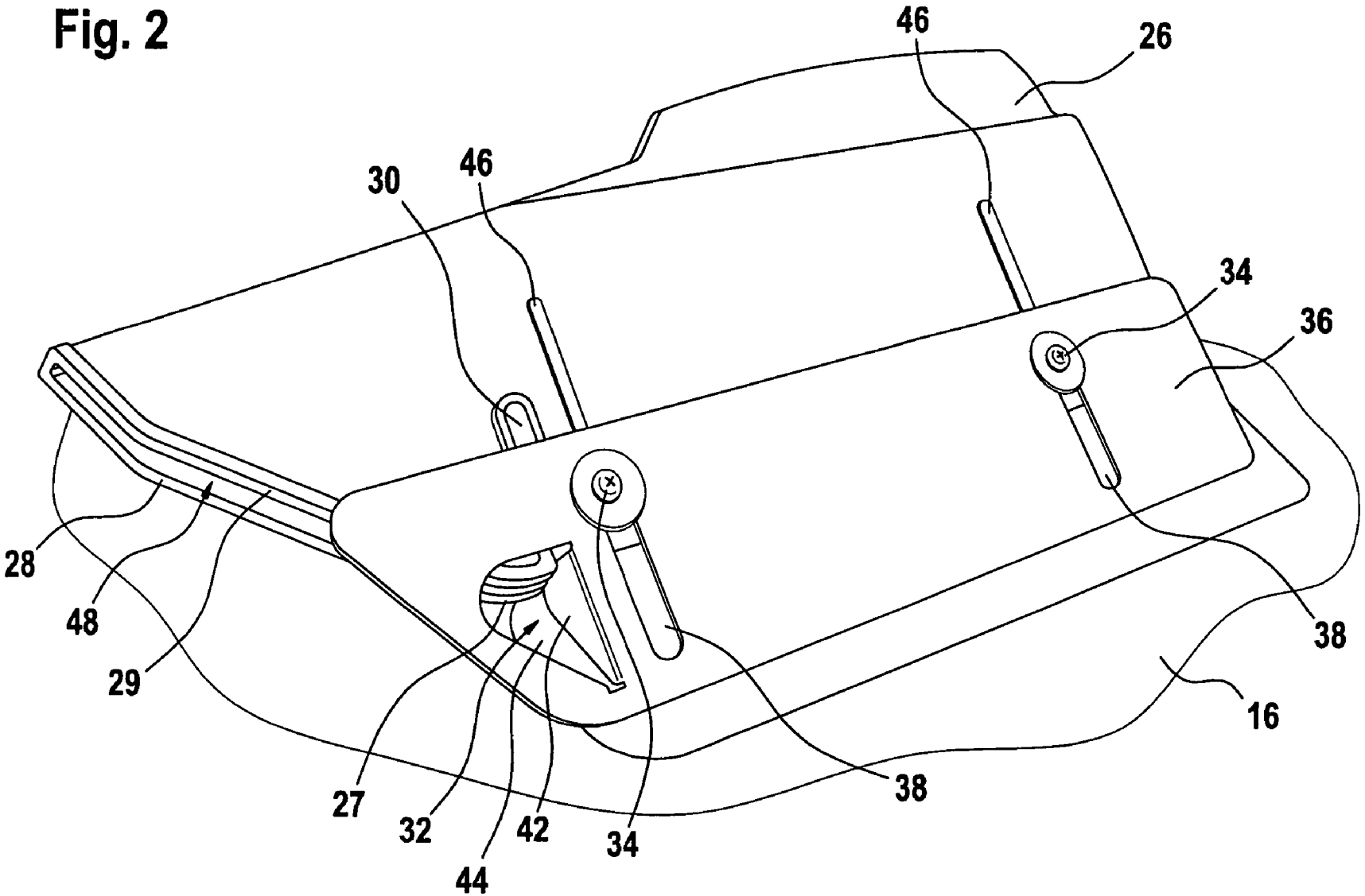
FIG. 2 shows a section of the table saw in FIG. 1 in the region of the guard.

FIG. 2 shows a section of table top 16 with guard 26, the saw blade 20 (FIG. 3) of which is swiveled to the left by approximately 45°, the movement of which guard 26 follows in a synchronous manner. A distinct gap 32 having a width of at least 1 cm has formed between lower edge 40 of side wall 29 and top side of table top 16, which is also safely closed by protective panel 36. Said protective panel has slid relative to right side wall 29 of guard 26 to the very bottom along its elongated holes 38. As a result, front opening 48 of guard 26 is simultaneously closed by tab 42 of protective panel 36.

Figure 3:
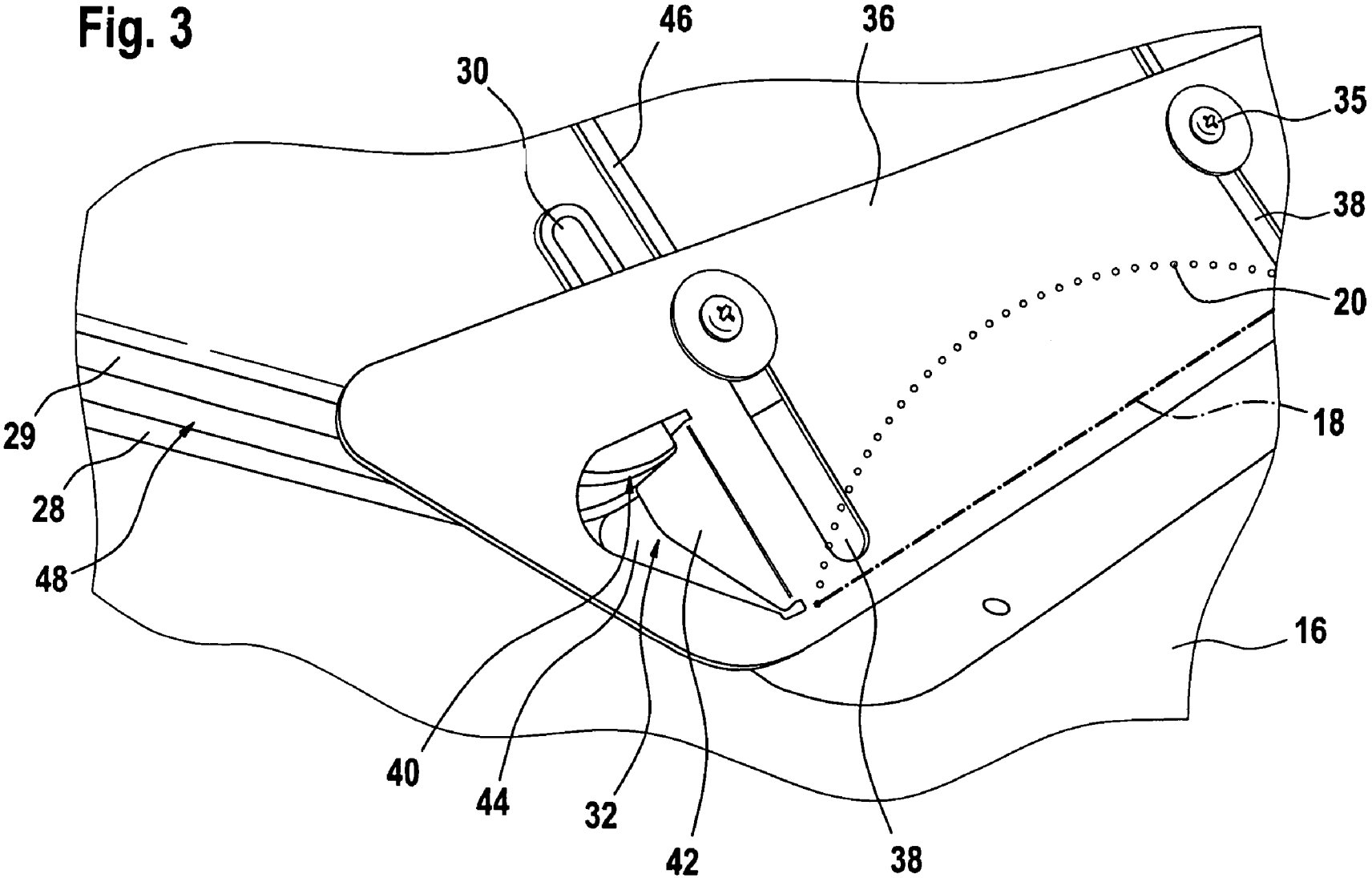
FIG. 3 shows an enlarged section according to FIG. 2.

FIG. 3 shows a section of FIG. 2; it is a partial, enlarged view of guard 26. The position of lower edge 27 of side wall 29 and a view of the bent tab 42 performing its closing function are shown particularly clearly. The longitudinally extending gap 32, i.e., the distance between lower edge 27 of side wall 29 relative to table top 16, is clearly visible, as is the way that protective panel 36—displaced parallel to side wall 28—closes this gap 32. The contour of saw blade 20 inside guard 36 is indicated using a line of circles, and slot 18 for passage of saw blade 20 through table top 16 is shown schematically as a dash-dotted line. Gliding ribs 46 and slot 30 in right side wall 29 are also shown clearly.

In the case of a saw assembly capable of swivelling toward either side, protective panels must be located on both side walls of the guard, of course.

What is claimed is:

1. A table saw (10) with a table top (16) over which a saw blade (20) is positioned, whereby the upper region is covered by a guard (26) which is height-adjustable relative to the saw blade (20), and whereby the saw blade (20) is angularly-displaceable relative to the table top (16), whereby a gap (32) forms between the guard (26) and the table top (16), wherein the guard (26) includes a protective panel (36) which is movably supported relative to the guard (26) and closes the gap (32) in a manner in particular such that it cannot be penetrated by the operator's fingers, wherein an offset tab (42) of the protective panel (36) extends, transverse thereto and parallel with elongated holes (38), through a side wall (29) of the guard (26) and extends to a diametrically opposed side wall (28).

2. The table saw as recited in claim 1, wherein the gap (32) closes automatically when it forms, regardless of its size.

3. The table saw as recited in claim 1, wherein the protective panel (36) bears with its narrow side against the table top (16), where it tries to remain due to its natural weight and, simultaneously, it is fastened via its flat side close to a side wall (28, 29) of the guard (26) such that it is movable in parallel therewith, and follows swivelling motions made by the guard (26).

4. The table saw as recited in one of the claims 1, wherein the protective panel (36) is supported on the side wall (29) which can form an obtuse angle with the table top (16) when the saw blade (20) is swivelled.

5. The table saw as recited in claim 1, wherein the protective panel (36) includes two elongated holes (38) extending substantially perpendicularly to the table top (16) and functioning as guide channels for a guided parallel displacement of the protective panel (36) relative to the side wall (29), each of the elongated holes being penetrated by a guide bolt (34) fastened in the side wall (29), the bolt heads (35) of which extend over the protective panel (36) and therefore hold it against the side wall (28) with minimum play and prevent it from coming loose.

6. The table saw as recited in claim 1, wherein a slot (30), which is open toward the bottom is located in the side wall (29) to allow passage of the offset tab (42) of the protective panel (36).

7. The table saw as recited in claim 1, wherein a side wall (29) includes gliding ribs (46) extending parallel to the elongated holes (38) in the protective panel (36), on which the protective panel (36) is capable of bearing with minimum wear.

8. The table saw as recited in claim 1, wherein the guard (26) is made of plastic and is transparent.

9. The table saw as recited in claim 1, wherein the guard (26) is height-adjustable relative to the table top (16), and is adjustable to the dimensions of work pieces having different dimensions to be guided between the guard (26) and the table top (16) and sawed.

* * * * *